US005952594A

United States Patent [19]

Chuang

[11] Patent Number: 5,952,594

[45] Date of Patent: Sep. 14, 1999

[54] SNAP-FASTENING STRUCTURE FOR SECURING A DRUM COUNTERHOOP TO A DRUM SHELL

[75] Inventor: Chi-Hua Chuang, Taipei, Taiwan

[73] Assignee: Reliance International Corp., Taipei, Taiwan

[21] Appl. No.: 09/197,515

[22] Filed: Nov. 23, 1998

[51] Int. Cl.[6] ..... G10D 13/02

[52] U.S. Cl. ..... 84/413; 84/411 R; 84/411 A; 84/412

[58] Field of Search ..... 84/413, 411 R, 84/411 A, 412, 420; 403/374.4, 374.3

[56] References Cited

U.S. PATENT DOCUMENTS

| | | | |
|---|---|---|---|
| 4,027,939 | 6/1977 | White | 339/247 |
| 4,134,324 | 1/1979 | LeMert | 84/411 R |
| 4,520,709 | 6/1985 | Kester, Jr. | 84/415 |
| 4,585,195 | 4/1986 | McFadden | 248/118 |
| 4,742,753 | 5/1988 | Speed | 84/414 |
| 4,786,204 | 11/1988 | Mayeda | 403/374 |
| 5,413,022 | 5/1995 | Sleishman | 84/413 |
| 5,606,142 | 2/1997 | Volpp | 84/411 R |

*Primary Examiner*—William M. Shoop, Jr.
*Assistant Examiner*—Kim Lockett
*Attorney, Agent, or Firm*—Bacon & Thomas, PLLC

[57] ABSTRACT

A snap-fastening structure of a drum comprises a fixing socket disposed laterally on a surface of a drum shell, a drum clasp snap-fastened at a counterhoop, and a link bolt penetrating the drum clasp to join the fixing socket. The drum clasp is a clamp body having a clamp-fastening portion extended downward and folded inward to form a clamping which provides, a firm retention of the drum clasp at the counterhoop and a buffer space for reducing influences to vibration of the batter head for thickening and solidifying the timbre of drumbeats.

1 Claim, 5 Drawing Sheets

SNAP-FASTENING STRUCTURE FOR SECURING A DRUM COUNTERHOOP TO A DRUM SHELL

BACKGROUND OF THE INVENTION

The invention relates to an improved snap-fastening structure of a drum, particularly to a snap-fastening structure with a better fastening efficacy that can be retained and positioned at the counterhoop efficiently and is capable of reducing influences to vibration of the batter head of a drum.

A snap-fastening structure is commonly used to combine a counterhoop with a drum shell to form a conventional drum. As shown in FIG. 1, a snap-fastening structure usually comprises a fixing socket, a drum clasp, and a tension bolt, wherein the fixing socket is disposed on lateral surface of the drum shell at a proper position; and the drum clasp is a clamp body folded to form a clamping portion snapping at the counterhoop; and the tension bolt penetrating the drum clasp is screw-jointed to the fixing socket for anchoring the counterhoop at the drum shell.

However, since the counterhoop is a circular hoop body, a flat clamp-fastening portion can not be fixed intimately to the areuate shape of the counterhoop, and moreover, in case the flat clamping fastening portion is relatively far wider than the thickness of the counterhoop, a clearance in between the drum clasp and the counterhoop will become larger accordingly to estrange intimacy of the drum clasp and the counterhoop so that the resonance of drumbeats may be affected to degrade the timbre.

Besides, as for space saving when packing the drums, the smaller drum is usually put into the middle drum, then the middle drum into the larger drum. In this packing process, the batter head of a relatively larger drum must be detached from the drum shell to accommodate the smaller drum, and in the case of a conventional drum, when the batter head is dismounted and removed from the drum shell, the drum clasps will be displaced from the original positions, and it is inconvenient and troublesome to resume positioning and tuning when reassembling.

SUMMARY OF THE INVENTION

In order to remedy the aforementioned defects, this invention comprises a drum clasp and a link bolt, wherein a clamp-fastening portion of the drum clasp is extended downward and folded inward to form an elastic clamping head to enable the drum clasp to clamp firmly at the counterhoop of a drum.

Another object of this invention is to provide a buffer space for reducing influences to vibration of the batter head to thicken and solidify the timbre of drum beats.

A further object of this invention is to keep the drum clasp at the counterhoop when the counterhoop is detached from the drum shell so that a re-tuning process wouldn't be necessary when reassembling.

BRIEF DESCRIPTION OF THE DRAWINGS

For a better understanding to the present invention, together with further advantages or features thereof, preferred embodiments will be described in detail below with reference to the annexed drawings in which.

DETAILED DESCRIPTION OF THE PREFERRED EMBODIMENTS

Figure 1:
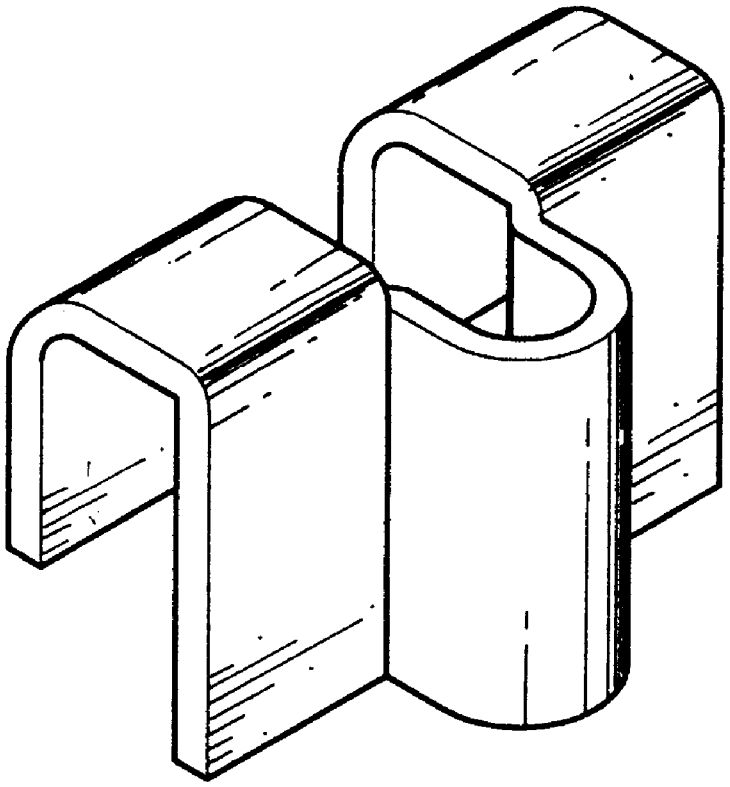
Fig. 1 PRIOR ART
FIG. 1 is a schematic view showing the snap-fastening structure of a conventional drum.
Figure 2:
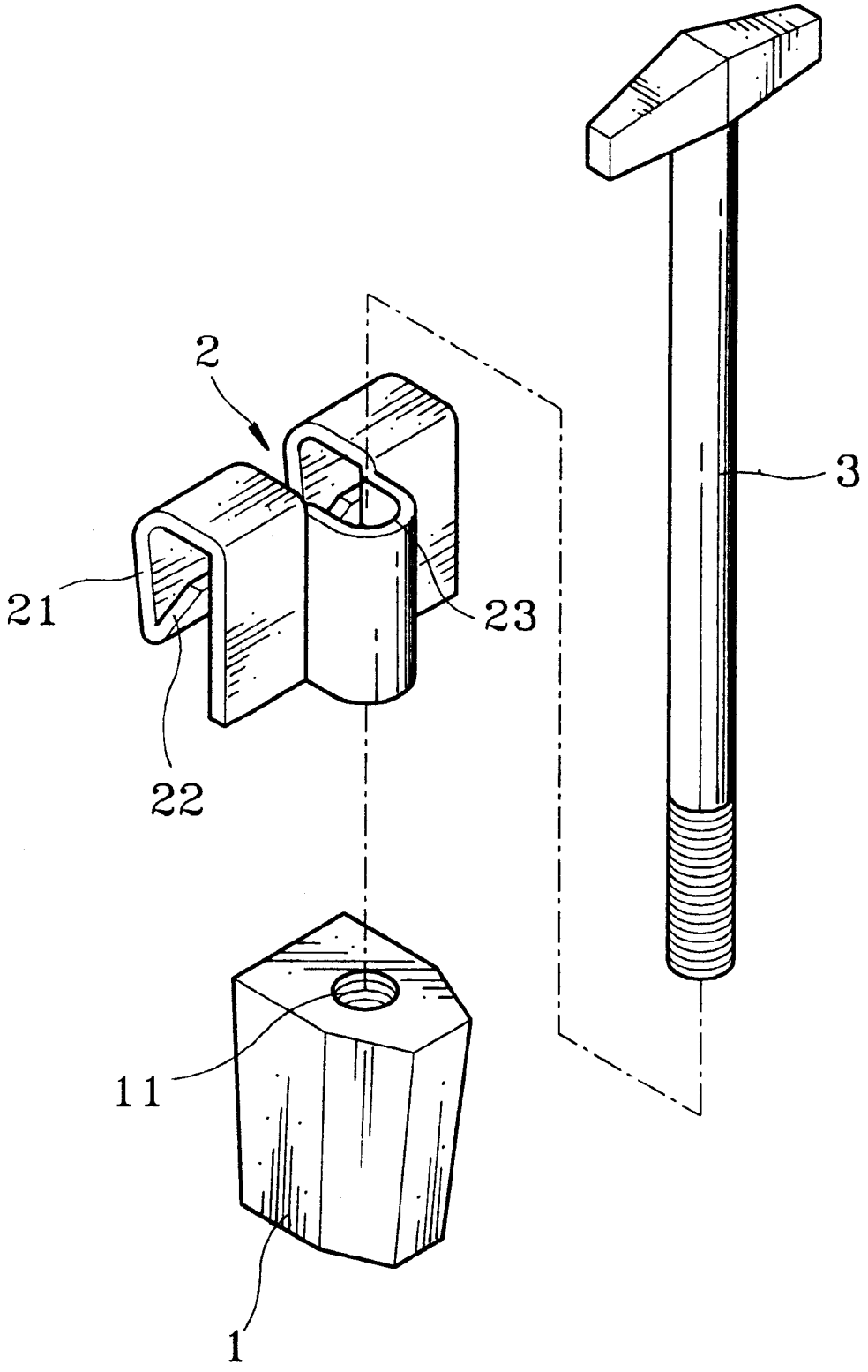
FIG. 2 is an exploded perspective view of a first embodiment of this invention.
Figure 3:
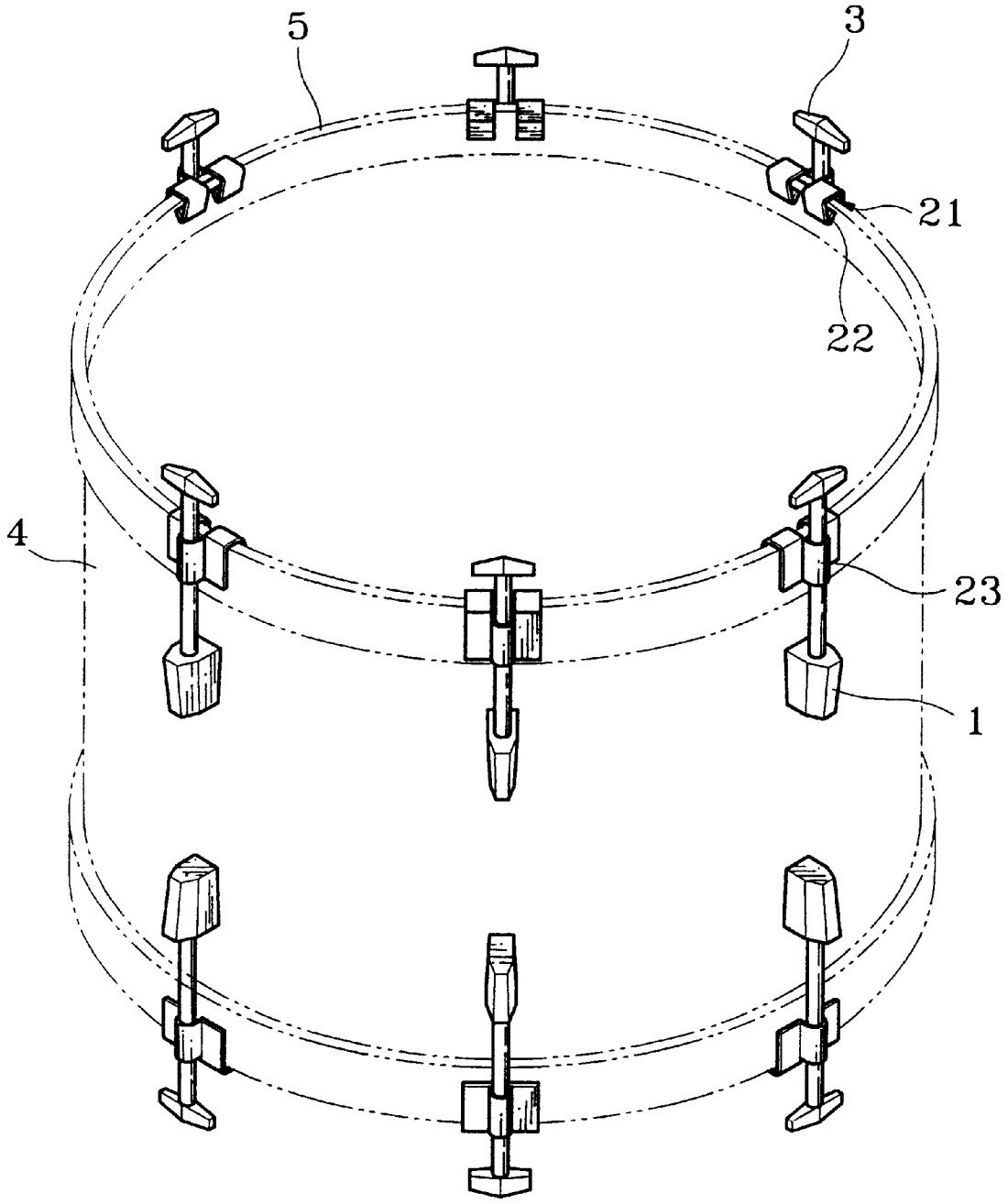
FIG. 3 is a perspective view showing application of the invention to a drum.

As shown in FIG. 2, the improved snap-fastening structure of this invention comprises a fixing socket 1, a drum clasp 2 and a link bolt 3 that unites the fixing socket 1 and the drum clasp 2, wherein the fixing socket 1 with a threaded bore 11 locates laterally on the drum shell 4 (As shown in FIG. 3) at an appropriate position.

A drum clasp 2 having a clamp-fastening portion 21 is clamp-fastened at a counterhoop 5, wherein the clamp-fastening portion 21 is extended downward and folded inward to form a clamping head 22, and in addition, a reception groove 23 is provided at a proper position in the clasp 2 for accommodating the threaded link bolt 3, which is a threaded rod used to penetrate the reception groove 23 and engage the threaded bore 11.

By availing itself of the above mentioned components, the clasp 2 of this invention can clamp firmly at the counterhoop 5 (As shown in FIG. 3) for positioning purpose and for waiving a re-tuning process when reassembling, and also to provide a buffer space that can reduce influences from vibration of the batter head of a drum.

Figure 4:
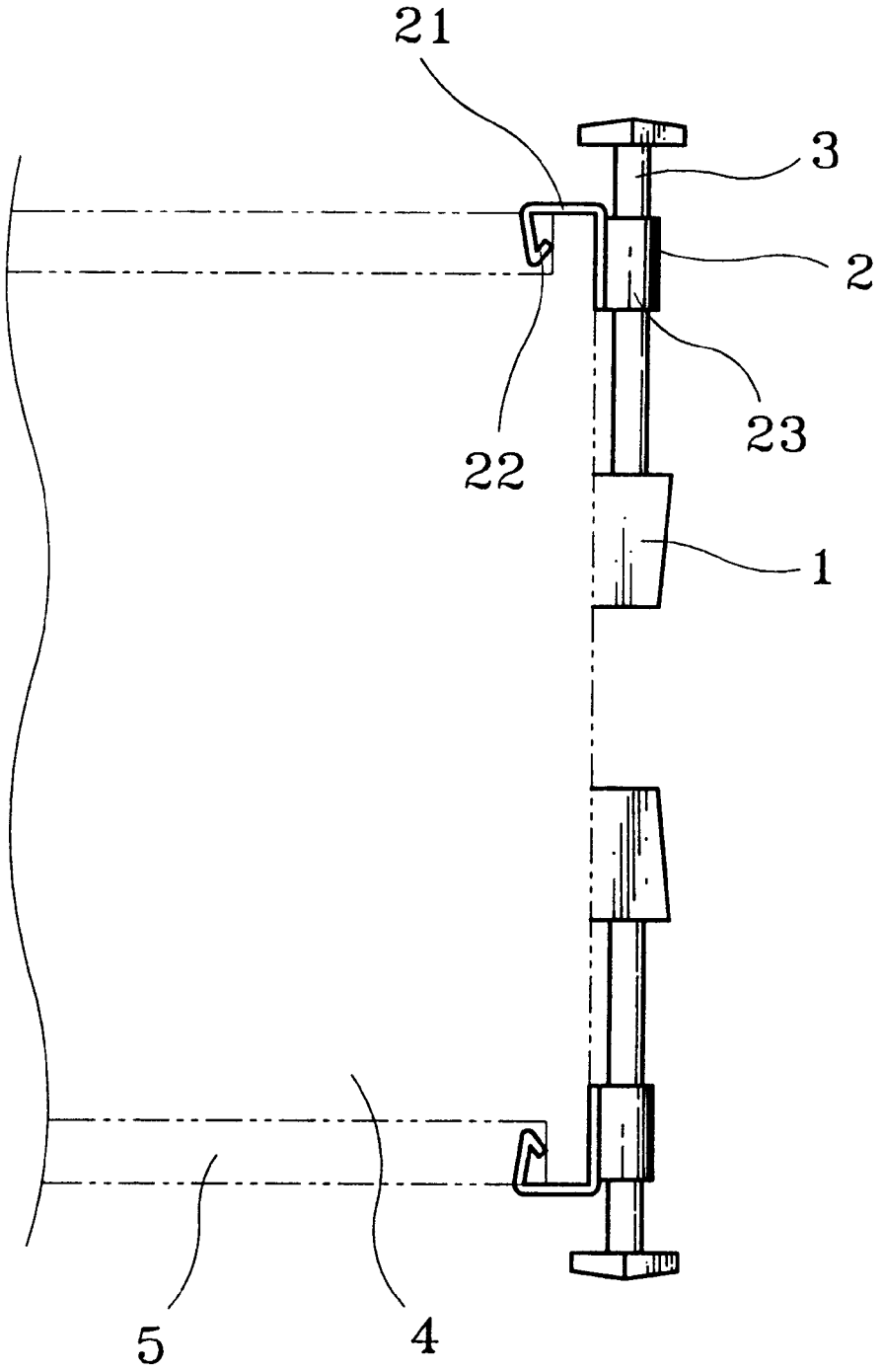
FIG. 4 is a side view of a portion of FIG. 3.

As shown in FIG. 3 and 4, a plurality of the structures of this invention are uniformly disposed laterally on the circumferential surface of a drum shell 4, wherein the fixing sockets 1 are distributed uniformly on lateral surface of the drum shell 4, and the drum clasps 2 are equally spaced and clamped at the counterhoop 5 by virtue of the clamp-fastening portions 21 at corresponding positions to the fixing sockets 1, and the link bolt 3 is employed to secure the reception groove 23 of the drum clasp 2 to the threaded bore 11 of the fixing socket 1 to combine the counterhoop 5 with the drum shell 4.

The clamping head 22 is formed by extending and folding the clamp-fastening portion 21, the latter receiving the counterhoop 5 at its inner side, and by elasticity of the clamping head 22, the drum clasp 2 can be clenched tightly at the counterhoop 5 and positioned properly. Such an arrangement eliminates the re-tuning process when reassembling a drum and provide a buffer space for reducing influences from vibration of the batter head in order to thicken and solidify the timbre of drumbeats.

Figure 5:
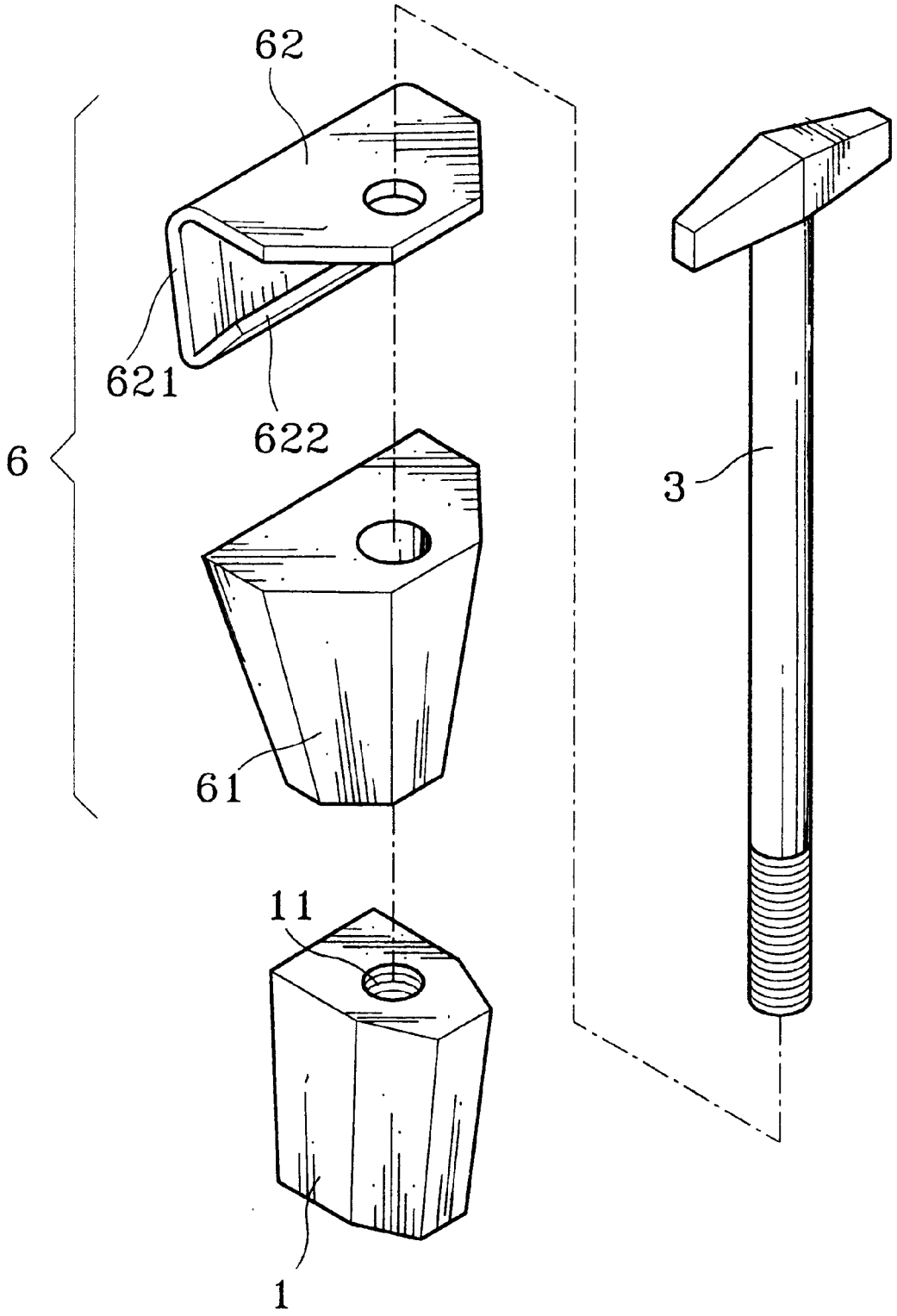
FIG. 5 is an exploded perspective view showing another embodiment of this invention.

As shown in FIG. 5, a drum clamp 6 of another embodiment of this invention comprises a clamp seat 61 and above it a clamp piece 62, wherein a free end of the clamp 62 is bent downward to form a clamping portion 621, which is further folded inward to form a clamping head 622. When the drum clamp 6 is retained at the counterhoop 5, a narrower clearance and a stable retention can be attained (As shown in FIG. 3), and moreover, a positioning efficacy that eliminates retuning when reassembling, and a buffer space instrumental to reduce influences to vibration of the batter head are also achievable.

Although, this invention has been described in terms of preferred embodiments, it is apparent that numerous variations and modifications may be made without departing from the true spirit and scope thereof, as set forth in the following claims.

What is claimed is:

1. A snap-fastening structure for securing a counterhoop of a drum to a drum shell, said snap-fastening structure comprising:

a fixing socket disposable on said drum shell;

a drum clasp for fastening onto said counterhoop, wherein said drum clasp includes a clamp body which is extended downward to form a clamp-fastening portion and folded inward to form a clamping head, and a reception groove;

a link bolt extendible through said reception groove to engage said fixing socket; and wherein said drum clasp may be firmly retained at said counterhoop to form a buffer space for thickening and solidifying the timbre of drumbeats and positioning said drum clasp at said counterhoop to eliminate retuning when reassembling a dismounted drum.

* * * * *